US010988869B2

(12) United States Patent
Takei et al.

(10) Patent No.: US 10,988,869 B2
(45) Date of Patent: Apr. 27, 2021

(54) MULTILAYER FABRIC

(71) Applicant: KABUSHIKI KAISHA TOYOTA JIDOSHOKKI, Kariya (JP)

(72) Inventors: Hiroyuki Takei, Kariya (JP); Ryuta Kamiya, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 491 days.

(21) Appl. No.: 15/767,478

(22) PCT Filed: Sep. 30, 2016

(86) PCT No.: PCT/JP2016/079026

§ 371 (c)(1),
(2) Date: Apr. 11, 2018

(87) PCT Pub. No.: WO2017/065022

PCT Pub. Date: Apr. 20, 2017

(65) Prior Publication Data

US 2018/0320296 A1 Nov. 8, 2018

(30) Foreign Application Priority Data

Oct. 15, 2015 (JP) ..... JP2015-203999

(51) Int. Cl.
*D03D 11/00* (2006.01)
*D03D 25/00* (2006.01)
*D03D 11/02* (2006.01)

(52) U.S. Cl.
CPC ..... *D03D 25/005* (2013.01); *D03D 11/00* (2013.01); *D03D 11/02* (2013.01); *D10B 2505/02* (2013.01)

(58) Field of Classification Search
CPC ..... D03D 25/005; D03D 11/02; D03D 1/00; D03D 11/00; D03D 13/00; D03D 3/00;
(Continued)

(56) References Cited

U.S. PATENT DOCUMENTS 970,906 A * 9/1910 Fisher ..... D03D 11/02 224/677
3,538,957 A * 11/1970 Rheaume ..... D03D 3/00 139/384 R (Continued)

FOREIGN PATENT DOCUMENTS

EP 1061164 A2 12/2000
JP 01-111038 A 4/1989

(Continued)

OTHER PUBLICATIONS

International Preliminary Report on Patentability with a Translation of Written Opinion issued from the International Bureau in counterpart International Application No. PCT/JP2016/079026, dated Apr. 17, 2018.

(Continued)

*Primary Examiner* — Robert H Muromoto, Jr.
(74) *Attorney, Agent, or Firm* — Sughrue Mion, PLLC

(57) ABSTRACT

A multilayer fabric includes a binding portion in which weft fiber layers stacked in a thickness-wise direction are all bound by warps and a non-binding portion including a slit where a fifth fiber layer and a seventh fiber layer, which are the weft fiber layers, are not bound by warps. The multilayer fabric includes an intersection formed at a boundary of the binding portion and the non-binding portion. The intersection is formed by intersecting the warps that are adjacent in a second direction.

3 Claims, 2 Drawing Sheets

(58) Field of Classification Search
CPC ..... D03D 1/02; D03D 25/00; D03D 41/004; D03D 13/002; D03D 3/02; D03D 3/06; D10B 2505/02; B29C 70/24; B29C 70/222; B29C 43/021; B29C 70/205
See application file for complete search history.

(56) References Cited

U.S. PATENT DOCUMENTS 4,719,837 A * 1/1988 McConnell ..... D04C 3/12 87/1
4,725,485 A * 2/1988 Hirokawa ..... D03D 25/005 139/DIG. 1
4,788,101 A * 11/1988 Sakatani ..... B29C 70/222 428/34.5
4,922,968 A * 5/1990 Bottger ..... B29C 70/222 139/384 R
5,080,142 A * 1/1992 Calamito ..... D03D 11/02 139/384 R
6,446,675 B1 * 9/2002 Goering ..... D03D 25/005 139/11
6,470,916 B1 10/2002 Uchida et al.
6,874,543 B2 * 4/2005 Schmidt ..... B29C 70/24 139/383 R
6,886,603 B2 5/2005 Uchida et al.
7,247,212 B2 * 7/2007 Kostar ..... D03D 25/005 156/89.11
7,655,581 B2 * 2/2010 Goering ..... D03D 11/02 442/205
7,712,488 B2 * 5/2010 Goering ..... B29C 70/222 139/384 R
7,943,535 B2 * 5/2011 Goering ..... D03D 25/005 442/205
8,079,387 B2 * 12/2011 Goering ..... D03D 25/005 139/11
8,505,588 B2 * 8/2013 Coupe ..... D03D 25/005 139/11
10,023,141 B2 * 7/2018 Tomioka ..... B32B 3/085
10,519,576 B2 * 12/2019 Marchal ..... B29C 70/24
2002/0056484 A1 * 5/2002 Uchida ..... D03D 25/00 139/383 R
2014/0349538 A1 * 11/2014 Marchal ..... B29B 11/16 442/206
2015/0167209 A1 * 6/2015 Marchal ..... F01D 5/28 416/230
2016/0375940 A1 12/2016 Tomioka et al.
2020/0031061 A1 * 1/2020 Takei ..... B29B 15/10

FOREIGN PATENT DOCUMENTS

JP 2000-355849 A 12/2000
JP 2015-505916 A 2/2015
JP 2017007571 A 1/2017

OTHER PUBLICATIONS

Communication dated Aug. 28, 2018, from the European Patent Office in counterpart European Application No. 16855276.8.
International Search Report of PCT/JP2016/079026 dated Dec. 13, 2016.

* cited by examiner

MULTILAYER FABRIC

CROSS REFERENCE TO RELATED APPLICATIONS

This application is a National Stage of International Application No. PCT/JP2016/079026 filed Sep. 30, 2016, claiming priority based on Japanese Patent Application No. 2015-203999 filed Oct. 15, 2015.

TECHNICAL FIELD

The present invention relates to a multilayer fabric.

BACKGROUND ART

A fiber-reinforced composite is widely used as a light-weight structural material. The fiber-reinforced composite includes a fiber structure serving as a reinforced base and includes a resin serving as a matrix. The fiber-reinforced composite is used as a structural material for airplanes, automobiles, buildings, and the like. For example, a tubular or hollow fiber-reinforced composite is used. Further, a multilayer fabric is used as a fiber structure of a fiber-reinforced composite.

A multilayer fabric is generally formed by stacking a plurality of fiber layers. That is, a weft fiber layer is formed by arranging a plurality of wefts in parallel to one another. A plurality of weft fiber layers are crimped by warps and bonded in a stacked state.

The multilayer fabric includes binding portions and non-binding portions. The non-binding portions are arranged in parts of the multilayer fabric in a warp direction and extend over the entire multilayer fabric in a weft direction. The non-binding portions include a separation part extending in the warp direction. The warps crimping the weft fiber layers do not bind the stacked weft fiber layers to form the separation part. The two ends of the separation part in the warp direction are defined by warps extending across the separation part in the stacking direction. A hollow or tubular multilayer fabric can be formed by widening and opening the separation part of the non-binding portion.

However, when opening the separation part, the warps defining the two ends of the separation part in the warp direction are pulled in the stacking direction. As a result, stress may concentrate on the warps and break the warps at the two ends of the separation part in the warp direction. Thus, in order to avoid tearing of the multilayer fabric in the warp direction, it is desirable that the strength be increased at the two ends of the separation part in the warp direction.

In patent document 1, the warp fiber layers that are adjacent in the stacking direction are not bound to form the separation part. Thus, the wefts that are adjacent in the stacking direction intersect at the ends of the separation part in the weft direction. Further, the ends of the separation part in the weft direction are reinforced by the adjacent weft intersection.

In a fiber structure described in patent document 1, the wefts that are adjacent in the stacking direction tend to be interfered with and damaged by one another at the intersections. In addition, the fiber density increases locally where the wefts intersect. This lowers the quality of the fabric.

PRIOR ART DOCUMENT

Patent Document

Patent Document 1: Japanese Laid-Open Patent Publication No. 2015-505916

SUMMARY OF THE INVENTION

Problems That are to be Solved by the Invention

It is an object of the present invention to provide a multilayer fabric that increases the strength at the ends of a separation part of the multilayer fabric without yarns interfering with one another.

Means for Solving the Problem

To solve the above problem, a first aspect of the present invention provides a multilayer fabric including a first direction yarn group and a second direction yarn group. The first direction yarn group includes a plurality of first direction yarns extending in a first direction. The first direction yarns are arranged in a depthwise direction and a thickness-wise direction. An axis in the depthwise direction is orthogonal to an axis in the first direction. An axis in the thickness-wise direction is orthogonal to the axis in the first direction and the axis in the depthwise direction. The second direction yarn group includes a plurality of second direction yarns extending in a second direction. The second direction yarns are arranged in the first direction and the thickness-wise direction. An axis in the second direction is orthogonal to the axis in the first direction. The second direction yarn group includes a plurality of second direction yarn layers that are arranged in parallel to the first direction. The multilayer fabric further includes a binding portion in which the second direction yarn layers that are stacked in the thickness-wise direction are all bound by the first direction yarns and a non-binding portion including a separation part where, among the second direction yarn layers, two of the second direction yarn layers that are adjacent in the thickness-wise direction are not bound by the first direction yarns. An intersection is formed at each of two ends of the separation part at a boundary of the binding portion and the non-binding portion. The intersection is formed by intersecting the first direction yarns that are adjacent in the second direction.

EMBODIMENTS OF THE INVENTION

First Embodiment

Figure 1:
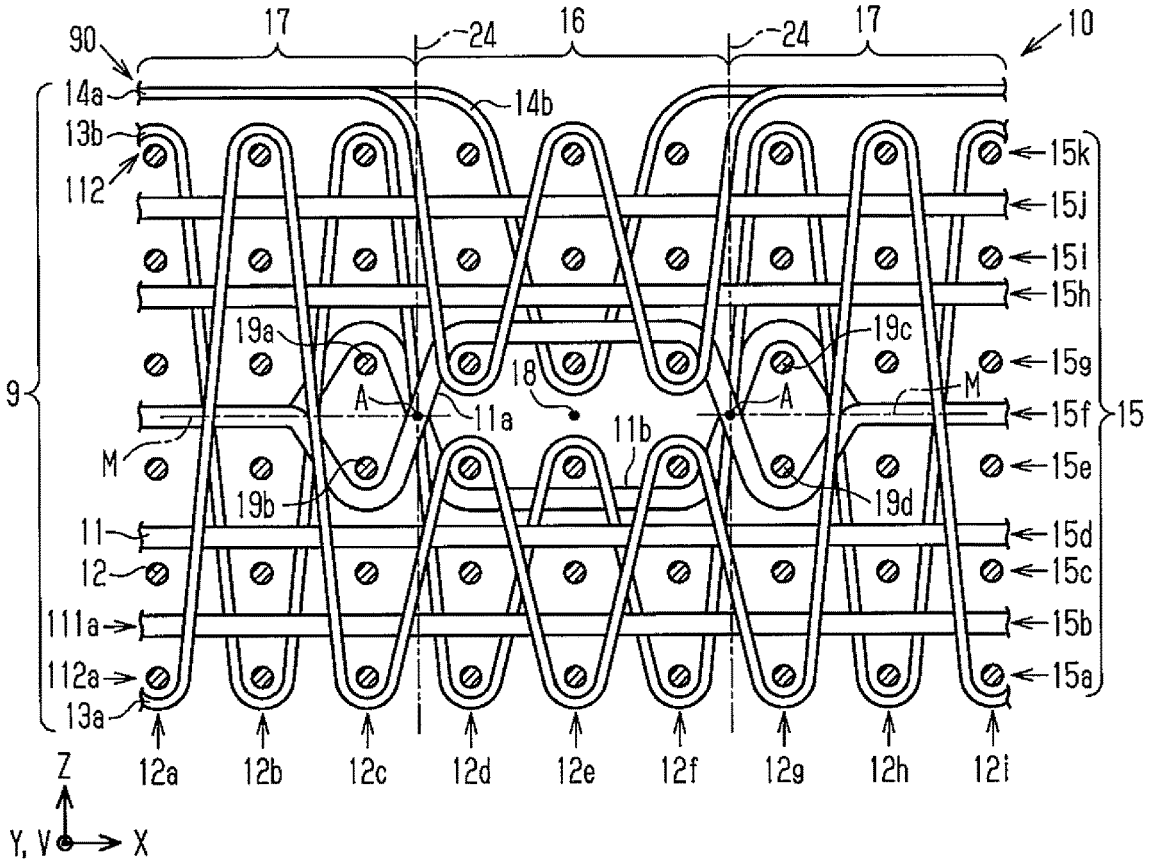
FIG. 1 is a cross-sectional side view showing a multilayer fabric according to a first embodiment of the present invention.

A first embodiment of a multilayer fabric will now be described with reference to FIGS. 1 to 3. In the following description, a first direction X, a second direction Y, a thickness-wise direction Z, and a depthwise direction V are defined as shown in FIG. 1. The second direction Y and the depthwise direction V are the same direction.

As shown in FIG. 1, a multilayer fabric 10 includes warps 9 serving as first direction yarns and main material wefts 12 serving as second direction yarns. The warps 9 are formed by main material warps 11, first crimp warps 13*a* to 13*b*, and second crimp warps 14*a* to 14*b*. The main material warps 11 are main material first direction yarns that extend straight in the first direction X. The first crimp warps 13*a* to 13*b* and the second crimp warps 14*a* to 14*b* are crimp first direction yarns that bind the main material warps 11 and the main material wefts 12. The main material warps 11 are arranged in parallel in the second direction Y to form warp fiber layers 111*a* serving as main material first direction yarn layers. The main material wefts 12 extend straight in the second direction Y. The main material wefts 12 are arranged in the first direction X to form weft fiber layers 112*a* serving as second direction yarn layers. The warp fiber layers 111*a* and the weft fiber layers 112*a* are alternately stacked in the thickness-wise direction Z, which is perpendicular to each of the layers.

The warps 9 form a warp group 90 serving as a first direction yarn group. The warp group 90 is formed by the warp fiber layers 111*a* stacked in the thickness-wise direction Z, the first crimp warps 13*a* to 13*b*, and the second crimp warps 14*a* to 14*b*. That is, the warp group 90 is formed by the warps 9 arranged in the thickness-wise direction Z and the depthwise direction V. The main material wefts 12 form a weft group 112 serving as a second direction yarn group. The weft group 112 is formed by the weft fiber layers 112*a* arranged in the thickness-wise direction Z. That is, the weft group 112 is formed by the main material wefts 12 arranged in the first direction X and the thickness-wise direction Z. The main material warps 11 and the main material wefts 12 are formed by reinforced fibers such as carbon fibers and glass fibers.

The warp fiber layers 111*a* and the weft fiber layers 112*a* are alternately arranged in the thickness-wise direction Z and bound to one another by the first crimp warps 13*a* to 13*b* and the second crimp warps 14*a* to 14*b*. In this case, the first crimp warps 13*a* to 13*b* are arranged in the second direction Y, and the second crimp warps 14*a* to 14*b* are arranged in the second direction Y. The first crimp warps 13*a* are adjacent to the first crimp warps 13*b* as viewed in the second direction Y. In the same manner, the second crimp warps 14*a* are adjacent to the second crimp warps 14*b* as viewed in the second direction Y. The first crimp warps 13*a* to 13*b* and the second crimp warps 14*a* to 14*b* are meandered in the first direction X to crimp the warp fiber layers 111*a* and the weft fiber layers 112*a* to the main material wefts 12. Fibers of, for example, nylon having a smaller diameter than the main material warps 11 and the main material wefts 12 are used as the first crimp warps 13*a* to 13*b* and the second crimp warps 14*a* to 14*b*.

The multilayer fabric 10 includes non-binding portions 16 and binding portions 17. The non-binding portions 16 are arranged in parts of the multilayer fabric 10 in the first direction X. The binding portions 17 are arranged at two sides of each of the non-binding portions 16 in the first direction X.

A binding structure of the main material warps 11 and the main material wefts 12 formed by the first crimp warps 13*a* to 13*b* and the second crimp warps 14*a* to 14*b* will now be described with reference to FIG. 1. In the following description, the row of the main material wefts 12 located at the leftmost side in FIG. 1 and arranged in the vertical direction is referred to as the first weft row 12*a*. Further, the rows from the first weft row 12*a* toward the right are referred in order as the second weft row 12*b*, the third weft row 12*c*, . . . , and the ninth weft row 12*i*. In addition, the warp fiber layers 111*a* and the weft fiber layers 112*a* are each referred to as a fiber layer 15, and the lowermost fiber layer 15 in FIG. 1 is referred to as the first fiber layer 15*a*. Further, the fiber layers 15 from the first fiber layer 15*a* toward the upper side are referred to in order as the second fiber layers 15*b*, the third fiber layers 15*c*, . . . , the tenth fiber layers 15*j*, and the eleventh fiber layers 15*k*.

As shown in FIG. 1, the first crimp warp 13*a* is engaged with the outer surface of the main material weft 12 included in the first weft row 12*a* and the first fiber layer 15*a* and then bent and crimped. Then, the first crimp warp 13*a* is extended in the thickness-wise direction Z from the first fiber layer 15*a* toward the eleventh fiber layer 15*k*.

Subsequently, the first crimp warp 13*a* is engaged with the outer surface of the main material weft 12 included in the second weft row 12*b*, which is adjacent to the first weft row 12*a*, and the eleventh fiber layer 15*k* and then bent and crimped. Then, the first crimp warp 13*a* is extended in the thickness-wise direction Z from the eleventh fiber layer 15*k* toward the first fiber layer 15*a*. Furthermore, the first crimp warp 13*a* is engaged with the outer surface of the main material weft 12 included in the third weft row 12*c* and the first fiber layer 15*a* and then bent and crimped.

The first crimp warp 13*b* is engaged with the outer surface of the main material weft 12 included in the first weft row 12*a* and the eleventh fiber layer 15*k* and then bent and crimped. Then, the first crimp warp 13*b* is extended in the thickness-wise direction Z from the eleventh fiber layer 15*k* toward the first fiber layer 15*a*. Subsequently, the first crimp warp 13*b* is engaged with the outer surface of the main material weft 12 included in the second weft row 12*b*, which is adjacent to the first weft row 12*a*, and the first fiber layer 15*a* and then bent and crimped. Then, the first crimp warp 13*b* is extended in the thickness-wise direction Z from the first fiber layer 15*a* toward the eleventh fiber layer 15*k*. Furthermore, the first crimp warp 13*b* is engaged with the outer surface of the main material weft 12 included in the third weft row 12*c* and the eleventh fiber layer 15*k* and then bent and crimped.

The first crimp warps 13*a* to 13*b* meander and advance from the first weft row 12*a* to the third weft row 12*c* to bind the alternately stacked warp fiber layers 111*a* and weft fiber layers 112*a*, namely, the first fiber layer 15*a* to the eleventh fiber layer 15*k*. Portions of the multilayer fabric 10 that are bound by the first crimp warps 13*a* to 13*b* in this manner define the binding portions 17. The binding portions 17 are formed by binding all of the weft fiber layers 112*a* stacked in the thickness-wise direction Z by the first crimp warps 13*a* to 13*b*.

From the third weft row 12*c*, the first crimp warp 13*a* is extended in the thickness-wise direction Z from the first fiber layer 15*a* to the fifth fiber layer 15*e* and engaged with the outer surface of the main material weft 12 included in the fourth weft row 12*d* and the fifth fiber layer 15*e* and then bent and crimped. Then, after being extended in the thickness-wise direction Z toward the first fiber layer 15*a*, the first crimp warp 13*a* is engaged with the outer surface of the main material weft 12 included in the fifth weft row 12*e*, which is adjacent to the fourth weft row 12*d*, and the first fiber layer 15*a* and then bent and crimped. Subsequently, after being extended in the thickness-wise direction Z toward the fifth fiber layer 15*e*, the first crimp warp 13*a* is engaged with the outer surface of the main material weft 12 included in the sixth weft row 12*f*, which is adjacent to the fifth weft row 12*e*, and the fifth fiber layer 15*e* and then bent and crimped.

From the third weft row 12*c*, the first crimp warp 13*b* is extended in the thickness-wise direction Z from the eleventh fiber layer 15*k* toward the first fiber layer 15*a* and engaged with the outer surface of the main material weft 12 included in the fourth weft row 12*d* and the first fiber layer 15*a* and then bent and crimped. Then, after being extended in the thickness-wise direction Z toward the fifth fiber layer 15*e*, the first crimp warp 13*b* is engaged with the outer surface of the main material weft 12 included in the fifth weft row 12*e*, which is adjacent to the fourth weft row 12*d*, and the fifth fiber layer 15*e* and then bent and crimped. Subsequently, after being extended in the thickness-wise direction Z toward the first fiber layer 15*a*, the first crimp warp 13*b* is engaged with the outer surface of the main material weft 12 included in the sixth weft row 12*f*, which is adjacent to the fifth weft row 12*e*, and the first fiber layer 15*a* and then bent and crimped.

From the seventh weft row 12*g* to the ninth weft row 12*i*, the first crimp warps 13*a* to 13*b* meander and advance from the first weft row 12*a* in the same manner as the third weft row 12*c* to bind the alternately stacked warp fiber layers 111*a* and weft fiber layers 112*a*, namely, the first fiber layer 15*a* to the eleventh fiber layer 15*k*. Portions of the multilayer fabric 10 that are bound by the first crimp warps 13*a* to 13*b* in this manner define the binding portions 17. The binding portions 17 are formed by binding all of the weft fiber layers 112*a* stacked in the thickness-wise direction Z by the first crimp warps 13*a* to 13*b*. That is, the first crimp warps 13*a* to 13*b* form the binding portion 17.

The second crimp warps 14*a* to 14*b* pass over the surface of the eleventh fiber layer 15*k* from the first weft row 12*a* to the third weft row 12*c*.

In the fourth weft row 12*d*, the second crimp warp 14*a* is extended in the thickness-wise direction Z from the eleventh fiber layer 15*k* toward the seventh fiber layer 15*g*. The second crimp warp 14*a* is engaged with the outer surface of the main material weft 12 included in the fourth weft row 12*d* and the seventh fiber layer 15*g* and then bent and crimped. Then, the second crimp warp 14*a* is extended in the thickness-wise direction Z toward the eleventh fiber layer 15*k*. Subsequently, the second crimp warp 14*a* is engaged with the outer surface of the main material weft 12 included in the fifth weft row 12*e*, which is adjacent to the fourth weft row 12*d*, and the eleventh fiber layer 15*k* and then bent and crimped. Then, the second crimp warp 14*a* is extended in the thickness-wise direction Z toward the seventh fiber layer 15*g*. Subsequently, the second crimp warp 14*a* is engaged with the outer surface of the main material weft 12 included in the sixth weft row 12*f*, which is adjacent to the fifth weft row 12*e*, and the seventh fiber layer 15*g* and then bent and crimped. Then, the second crimp warp 14*a* is extended in the thickness-wise direction Z toward the surface of the eleventh fiber layer 15*k*.

The second crimp warp 14*b* passes over the surface of the eleventh fiber layer 15*k* from the third weft row 12*c* to the fourth weft row 12*d*. In the fifth weft row 12*e*, the second crimp warp 14*b* is extended in the thickness-wise direction Z from the eleventh fiber layer 15*k* toward the seventh fiber layer 15*g*. The second crimp warp 14*b* is engaged with the outer surface of the main material weft 12 included in the fifth weft row 12*e* and the seventh fiber layer 15*g* and then bent and crimped. Then, the second crimp warp 14*b* is extended in the thickness-wise direction Z toward the surface of the eleventh fiber layer 15*k*. Subsequently, the second crimp warp 14*b* passes over the surface of the eleventh fiber layer 15*k* in the sixth weft row 12*f*.

The second crimp warps 14*a* to 14*b* pass over the surface of the eleventh fiber layer 15*k* from the seventh weft row 12*g* to the ninth weft row 12*i*.

The first crimp warps 13*a* to 13*b* and the second crimp warps 14*a* to 14*b* form the non-binding portions 16 from the fourth weft row 12*d* to the sixth weft row 12*f*. Each non-binding portion 16 includes a slit 18 serving as a separation part separating the warp fiber layer 111*a* and the weft fiber layer 112*a* in the thickness-wise direction Z. The fifth fiber layer 15*e*, which is crimped by the first crimp warps 13*a* to 13*b*, forms a gap defining the slit 18 with the seventh fiber layer 15*g*, which is crimped by the second crimp warps 14*a* to 14*b*. The slit 18 extends over the entire multilayer fabric 10 in the second direction Y. The fifth fiber layer 15*e* and the seventh fiber layer 15*g*, which are adjacent to each other in the thickness-wise direction Z, are not bound by the first crimp warps 13*a* to 13*b* and the second crimp warps 14*a* to 14*b* to form the slit 18.

The structure for reinforcing the two ends of the slit 18 in the first direction X will now be described in detail with reference to FIGS. 1 to 3.

As shown in FIG. 1, the reinforcement structure of the slit 18 includes interlacing wefts 19*a* to 19*d* serving as main material wefts. The interlacing weft 19*a* is the main material weft 12 included in the third weft row 12*c*, which is adjacent to one end of the non-binding portion 16 in the first direction X, and the seventh fiber layer 15*g*. The interlacing weft 19*b* is the main material weft 12 that is included in the third weft row 12*c* and the fifth fiber layer 15*e*. The interlacing weft 19*c* is the main material weft 12 included in the seventh weft row 12*g*, which is adjacent to the other end of the non-binding portion 16 in the first direction X, and the seventh fiber layer 15*g*. The interlacing weft 19*d* is the main material weft 12 that is included in the seventh weft row 12*g* and the fifth fiber layer 15*e*. Main material warps 11*a* to 11*b* are formed by the main material warps 11 of the sixth fiber layer 15*f*. The main material warps 11*a* to 11*b* are arranged in the depthwise direction V.

A straight line extending in the first direction X between the fifth fiber layer 15*e* and the seventh fiber layer 15*g* is referred to as the center line M of the multilayer fabric 10. When the multilayer fabric 10 is viewed in the first direction X, the main material warps 11*a* to 11*b* pass over the center line M in the first weft row 12*a* and the second weft row 12*b* of one of the binding portions 17.

Figure 2:
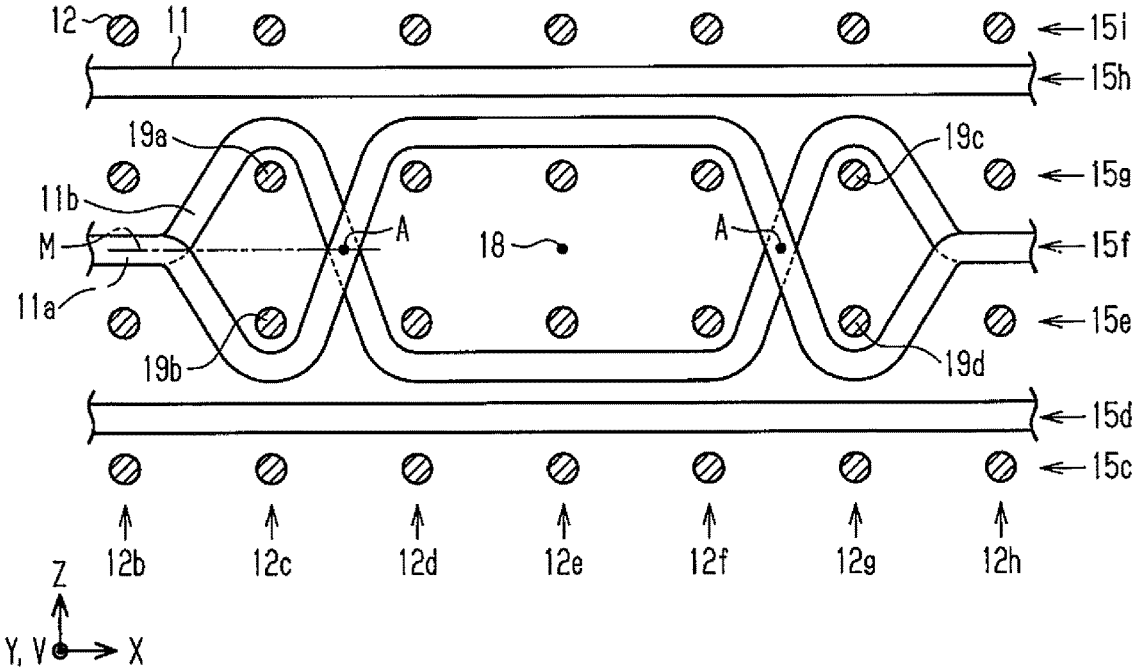
FIG. 2 is an enlarged cross-sectional view showing the vicinity of a slit.

As shown in FIG. 2, the main material warp 11*a* crimps the outer surface of the interlacing weft 19*b* included in the third weft row 12*c*, and the main material warp 11*b* crimps the outer surface of the interlacing weft 19*a* included in the third weft row 12*c*. The main material warp 11*a* passes through the space between the seventh fiber layer 15*g* and the eighth fiber layer 15*h* and then crimps the outer surface of the interlacing weft 19*d* included in the seventh weft row 12*g*. The main material warp 11*b* passes through the space between the fourth fiber layer 15*d* and the fifth fiber layer 15*e* and then crimps the outer surface of the interlacing weft 19*c* included in the seventh weft row 12*g*.

As shown in FIG. 1, when the multilayer fabric 10 is viewed in the first direction X, the main material warps 11*a* to 11*b* pass over the center line M in the eighth weft row 12*h* and the ninth weft row 12*i* of the other one of the binding portions 17. Further, the main material warps 11*a* to 11*b* are alternately crimped at boundaries 24 of the non-binding portions 16 and the binding portions 17 to form intersections A. When the multilayer fabric 10 is viewed in the second direction X, the intersections A are formed by intersecting the main material warps 11 and the main material warps 11*b*, which are adjacent in the second direction Y. The intersections A are located at the two ends of each of the slits 18 in the first direction X. In the present embodiment, the intersections A are formed by the main material warps 11*a* to 11*b* of the sixth fiber layer 15*f*.

Figure 3:
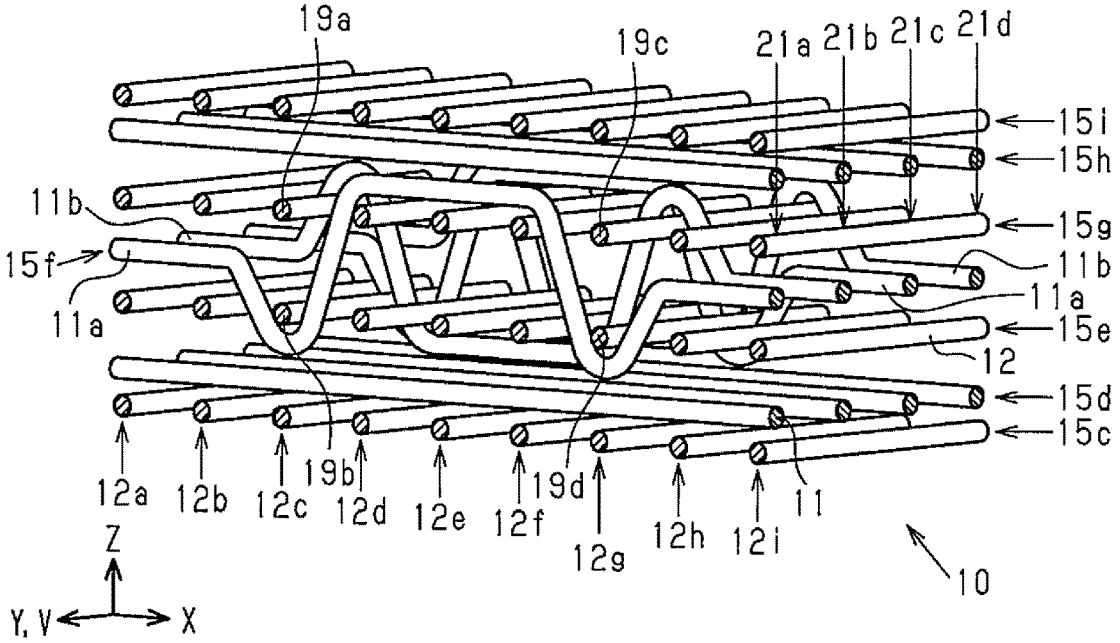
FIG. 3 is a partial perspective view showing the multilayer fabric.

As shown in FIG. 3, planes including the main material warps 11 arranged in the thickness-wise direction Z are defined as the first plane 21*a*, the second plane 21*b*, the third plane 21*c*, and the fourth plane 21*d*, in order in the depthwise direction V.

The main material warp 11 of the sixth fiber layer 15*f* located on the first plane 21*a* is the main material warp 11*a*. The main material warp 11 of the sixth fiber layer 15*f* located on the second plane 21*b* is the main material warp 11*b*. In the same manner, the main material warp 11 of the sixth fiber layer 15*f* located on the third plane 21*c* is the main material warp 11*a*. The main material warp 11 of the sixth fiber layer 15*f* located on the fourth plane 21*d* is the main material warp 11*b*. When the multilayer fabric 10 is viewed in the depthwise direction V, the main material warp 11*a* is crimped by the interlacing wefts 19*b* and 19*d*, which are adjacent to the two ends of the slit 18 in the first direction X, in a certain phase. The main material warp llb is crimped by the interlacing wefts 19*a* and 19*c*, which are adjacent to the two ends of the slit 18 in the first direction X, in the opposite phase of the main material warp 11*a*.

The operation of the first embodiment will now be described with reference to FIGS. 1 and 3.

As shown in FIG. 3, when the multilayer fabric 10 is viewed in the depthwise direction V, the main material warp 11*a* and the main material warp 11*b* have an opposite-phase relationship. Further, as shown in FIGS. 1 and 3, the main material warp 11*a* and the main material warp 11*b* intersect each other on the center line M at the two ends of the slit 18 in the first direction X. This forms the intersections A at the boundaries 24 of the non-binding portions 16 and the binding portions 17. Further, the main material warp 11*a* and the main material warp 11*b* crimp the outer surfaces of the interlacing wefts 19*a* to 19*d* included in the third weft row 12*c* and the seventh weft row 12*g*.

The above embodiment has the advantages described below.

(1) The multilayer fabric 10 includes the non-binding portions 16 and the binding portions 17. The weft fiber layers 112*a* stacked in the thickness-wise direction Z are all bound with the first crimp warps 13*a* to 13*b* to form the binding portions 17. The fifth fiber layer 15*e* and the seventh fiber layer 15*g* are not bound in the thickness-wise direction Z with the first crimp warps 13*a* to 13*b* and the second crimp warps 14*a* to 14*b* to form the non-binding portions 16. When the multilayer fabric 10 is viewed in the second direction Y, the boundaries 24 of the binding portions 17 and the non-binding portions 16 include the intersections A, which are formed by intersecting the adjacent main material warps 11*a* and 11*b*.

As a result, when the slits 18 of the non-binding portions 16 are widened and opened, the fifth fiber layer 15*e* is spaced apart from the seventh fiber layer 15*g*. This pulls the main material warps 11*a* to 11*b* of the intersections A in the thickness-wise direction Z. The main material warps 11*a* to 11*b* of the intersections A tighten the interlacing wefts 19*a* to 19*d* and the main material wefts 12, which are crimped by the main material warps 11*a* to 11*b*, so that the main material warps 11*a* to 11*b* pull the interlacing wefts 19*a* to 19*d* and the main material wefts 12 in the thickness-wise direction Z. This restricts situations in which the two ends of the slit 18 in the first direction X move in the thickness-wise direction Z. As a result, the strength increases at the two ends of the slit 18 in the first direction X.

Further, the main material warps 11*a* to 11*b* of the intersections A are arranged adjacent to each other in the second direction Y. This restricts interference of the main material warps 11*a* with the main material warps 11*b* at the intersections A. Thus, the fiber density does not locally become high at the proximity of the two ends of the slit 18 in the first direction X.

(2) The fifth fiber layer 15*e* and the seventh fiber layer 15*g*, which are the weft fiber layers 112*a*, are not bound in the thickness-wise direction Z by the first crimp warps 13*a* to 13*b* and the second crimp warps 14*a* to 14*b* to form the slit 18. Further, the intersections A are formed at the boundaries 24 of the binding portions 17 and the non-binding portions 16 by the sixth fiber layer 15*f*, which is formed by the main material warps 11*a* to 11*b*. The non-binding portions 16 including the slits 18 are formed by controlling the crimping process of the first crimp warps 13*a* to 13*b* and the second crimp warps 14*a* to 14*b*. Thus, the main material warps 11 and the main material wefts 12 can be extended straight in a single direction even at the proximity of the non-binding portions 16. Accordingly, the multilayer fabric 10 has superior dynamic properties in both of the first direction X and the second direction Y.

Second Embodiment

A second embodiment of the multilayer fabric 10 will now be described with reference to FIG. 4. The second embodiment differs from the first embodiment in that the main material warps 11*a* to 11*b* pass through the inside of the slit 18 and that the main material warps 11*a* to 11*b* include non-interlacing portions 22 that are not bound by the first crimp warps 13*a* to 13*b* and the second crimp warps 14*a* to 14*b*. In the second embodiment, like or same reference numerals are given to those components that are the same as the corresponding components of the first embodiment. Such components will not be described in detail.

Figure 4:
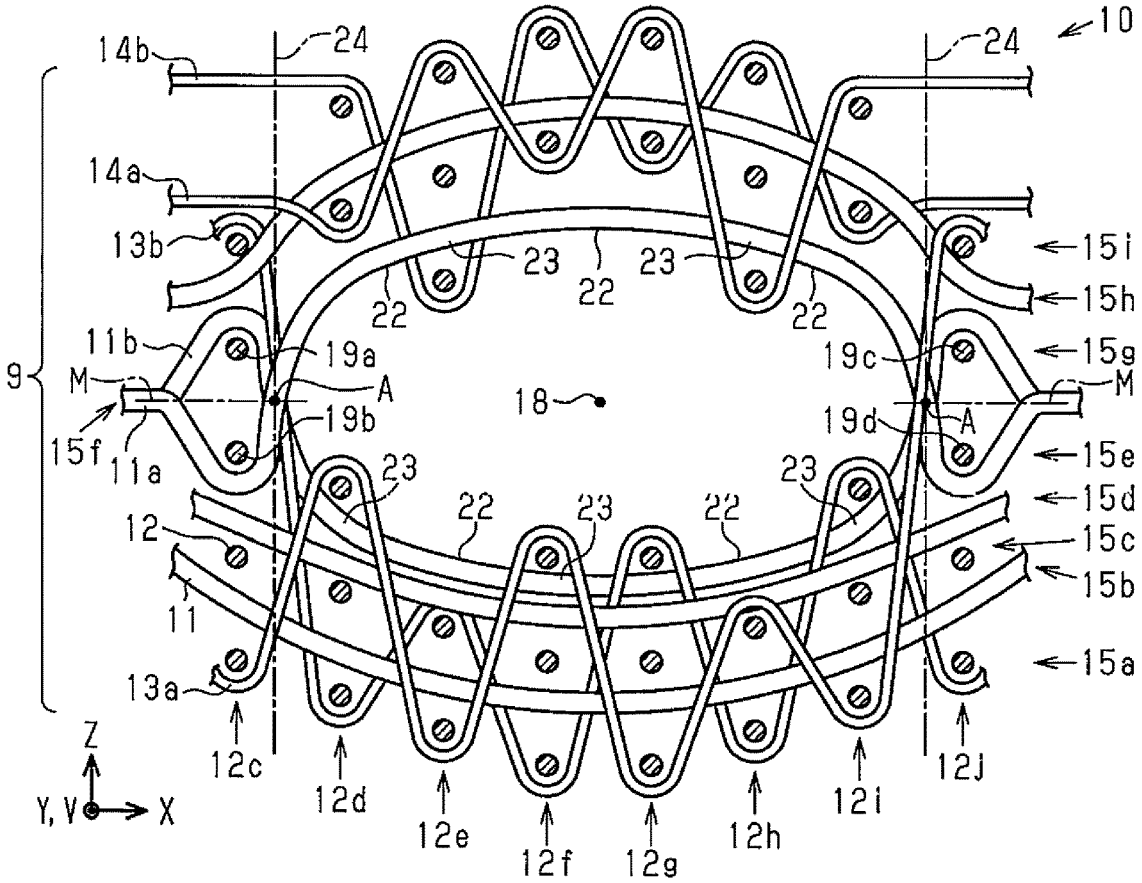
FIG. 4 is a cross-sectional side view showing the structure of a multilayer fabric including a non-interlacing portion according to a second embodiment of the present invention.

As shown in FIG. 4, the first crimp warp 13*a* is engaged with the outer surface of the main material weft 12 included in the third weft row 12*c* and the first fiber layer 15*a* and then bent and crimped. Subsequently, after being extended in the thickness-wise direction Z from the first fiber layer 15*a* toward the fifth fiber layer 15*e*, the first crimp warp 13*a* is engaged with the outer surface of the main material weft 12 included in the fourth weft row 12*d* and the fifth fiber layer 15*e* and then bent crimped.

After being extended toward the first fiber layer 15*a* in the thickness-wise direction Z, the first crimp warp 13*a* is engaged with the outer surface of the main material weft 12 included in the fifth weft row 12*e*, which is adjacent to the fourth weft row 12*d*, and the first fiber layer 15*a* and then bent and crimped. Subsequently, after being extended toward the fifth fiber layer 15*e* in the thickness-wise direction Z, the first crimp warp 13*a* is engaged with the outer surface of the main material weft 12 included in the sixth weft row 12*f*, which is adjacent to the fifth weft row 12*e*, and the fifth fiber layer 15*e* and then bent and crimped.

After being extended toward the first fiber layer 15*a* in the thickness-wise direction Z, the first crimp warp 13*a* is engaged with the outer surface of the main material weft 12 included in the seventh weft row 12*g*, which is adjacent to the sixth weft row 12*f*, and the first fiber layer 15*a* and then bent and crimped. Subsequently, after being extended toward the third fiber layer 15*c* in the thickness-wise direction Z, the first crimp warp 13*a* is engaged with the outer surface of the main material weft 12 included in the eighth weft row 12*h*, which is adjacent to the seventh weft row 12*g*, and the third fiber layer 15*c* and then bent and crimped.

After being extended toward the first fiber layer 15*a* in the thickness-wise direction Z, the first crimp warp 13*a* is engaged with the outer surface of the main material weft 12 included in the ninth weft row 12*i*, which is adjacent to the eighth weft row 12*h*, and the first fiber layer 15*a* and then bent and crimped. Subsequently, after being extended toward the eighth fiber layer 15*h*, the first crimp warp 13*a* is engaged with the outer surface of the main material weft 12 included in the tenth weft row 12*j*, which is adjacent to the ninth weft row 12*i*, and the ninth fiber layer 15*i* and then bent and crimped.

In this manner, among the fourth weft row 12*d*, the sixth weft row 12*f*, and the eighth weft row 12*h* arranged in the first direction X in the non-binding portion 16, the first crimp warp 13*a* is crimped by the main material weft 12 of the fifth fiber layer 15*e* in the fourth weft row 12*d* and the sixth weft row 12*f*. The first crimp warp 13*a* is crimped by the main material weft 12 of the third fiber layer 15*c* in the eighth weft row 12*h*.

The first crimp warp 13*b* is engaged with the outer surface of the main material weft 12 included in the third weft row 12*c* and the ninth fiber layer 15*i* and then bent and crimped. Subsequently, after being extended in the thickness-wise direction Z from the ninth fiber layer 15*i* toward the first fiber layer 15*a*, the first crimp warp 13*b* is engaged with the outer surface of the main material weft 12 included in the fourth weft row 12*d* and the first fiber layer 15*a* and then bent and crimped.

After being extended toward the third fiber layer 15*c* in the thickness-wise direction Z, the first crimp warp 13*b* is engaged with the outer surface of the main material weft 12 included in the fifth weft row 12*e*, which is adjacent to the fourth weft row 12*d*, and the third fiber layer 15*c* and then bent and crimped. Subsequently, after being extended toward the first fiber layer 15*a* in the thickness-wise direction Z, the first crimp warp 13*b* is engaged with the outer surface of the main material weft 12 included in the sixth weft row 12*f*, which is adjacent to the fifth weft row 12*e*, and the first fiber layer 15*a* and then bent and crimped.

After being extended toward the fifth fiber layer 15*e* in the thickness-wise direction Z, the first crimp warp 13*b* is engaged with the outer surface of the main material weft 12 included in the seventh weft row 12*g*, which is adjacent to the sixth weft row 12*f*, and the fifth fiber layer 15*e* and then bent and crimped. Subsequently, after being extended toward the first fiber layer 15*a* in the thickness-wise direction Z, the first crimp warp 13*b* is engaged with the outer surface of the main material weft 12 included in the eighth weft row 12*h*, which is adjacent to the seventh weft row 12*g*, and the first fiber layer 15*a* and then bent and crimped.

After being extended toward the fifth fiber layer 15*e* in the thickness-wise direction Z, the first crimp warp 13*b* is engaged with the outer surface of the main material weft 12 included in the ninth weft row 12*i*, which is adjacent to the eighth weft row 12*h*, and the fifth fiber layer 15*e* and then bent and crimped. Subsequently, after being extended toward the first fiber layer 15*a* in the thickness-wise direction Z, the first crimp warp 13*b* is engaged with the outer surface of the main material weft 12 included in the tenth weft row 12*j*, which is adjacent to the ninth weft row 12*i*, and the first fiber layer 15*a* and then bent and crimped.

In this manner, among the fifth weft row 12*e*, the seventh weft row 12*g*, and the ninth weft row 12*i* arranged in the first direction X in the non-binding portion 16, the first crimp warp 13*b* is crimped by the main material weft 12 of the fifth fiber layer 15*e* in the seventh weft row 12*g* and the ninth weft row 12*i*. The first crimp warp 13*b* is crimped by the main material weft 12 of the third fiber layer 15*c* in the fifth weft row 12*e*.

In the fourth weft row 12*d*, the second crimp warp 14*a* is extended in the thickness-wise direction Z from the surface of the ninth fiber layer 15*i* toward the seventh fiber layer 15*g*. The second crimp warp 14*a* is engaged with the outer surface of the main material weft 12 included in the fourth weft row 12*d* and the seventh fiber layer 15*g* and then bent and crimped. Then, the second crimp warp 14*a* is extended toward the ninth fiber layer 15*i* in the thickness-wise direction Z. Subsequently, the second crimp warp 14*a* is engaged with the outer surface of the main material weft 12 included in the fifth weft row 12*e*, which is adjacent to the fourth weft row 12*d*, and the ninth fiber layer 15*i* and then bent and crimped. Then, the second crimp warp 14*a* is extended toward the seventh fiber layer 15*g* in the thickness-wise direction Z. Subsequently, the second crimp warp 14*a* is engaged with the outer surface of the main material weft 12 included in the sixth weft row 12*f*, which is adjacent to the fifth weft row 12*e*, and the seventh fiber layer 15*g* and then bent and crimped. Then, the second crimp warp 14*a* is extended toward the ninth fiber layer 15*i* in the thickness-wise direction Z.

The second crimp warp 14*a* is engaged with the outer surface of the main material weft 12 included in the seventh weft row 12*g*, which is adjacent to the sixth weft row 12*f*, and the ninth fiber layer 15*i* and then bent and crimped. Then, the second crimp warp 14*a* is extended beyond the main material warp 11*a* to the inner side of the slit 18 in the thickness-wise direction Z. The second crimp warp 14*a* is engaged with the outer surface of the main material weft 12 included in the eighth weft row 12*h*, which is adjacent to the seventh weft row 12*g*, and the fifth fiber layer 15*e* and arranged at the inner side of the slit 18, and then bent and crimped. Then, the second crimp warp 14*a* is extended toward the ninth fiber layer 15*i* in the thickness-wise direction Z. The second crimp warp 14*a* is engaged with the outer surface of the main material weft 12 included in the ninth weft row 12*i*, which is adjacent to the eighth weft row 12*h*, and the ninth fiber layer 15*i* and then bent and crimped.

In this manner, among the fourth weft row 12*d*, the sixth weft row 12*f*, and the eighth weft row 12*h* arranged in the first direction X in the non-binding portion 16, the second crimp warp 14*a* is crimped by the main material weft 12 of the seventh fiber layer 15*g* in the fourth weft row 12*d* and the sixth weft row 12*f*. In the eighth weft row 12*h*, the second crimp warp 14*a* is crimped by the main material weft 12 of the fifth fiber layer 15*e* to bind the main material warp 11*a* in the thickness-wise direction Z.

In the fourth weft row 12*d*, the second crimp warp 14*b* is engaged with the outer surface of the main material weft 12 included in the ninth fiber layer 15*i* and then bent and crimped. Then, the second crimp warp 14*b* is extended beyond the main material warp 11*a* to the inner side of the slit 18 in the thickness-wise direction Z. The second crimp warp 14*b* is engaged with the outer surface of the main material weft 12 included in the fifth weft row 12*e*, which is adjacent to the fourth weft row 12*d*, and the fifth fiber layer 15*e* and arranged at the inner side of the slit 18 and then bent and crimped. Then, the second crimp warp 14*b* is extended toward the ninth fiber layer 15*i* in the thickness-wise direction Z. Subsequently, the second crimp warp 14*b* is engaged with the outer surface of the main material weft 12 included in the sixth weft row 12*f*, which is adjacent to the fifth weft row 12*e*, and the ninth fiber layer 15*i* and then bent and crimped. Then, the second crimp warp 14*b* is extended toward the seventh fiber layer 15*g* in the thickness-wise direction Z.

The second crimp warp 14*b* is engaged with the outer surface of the main material weft 12 included in the seventh weft row 12*g*, which is adjacent to the sixth weft row 12*f*, and the seventh fiber layer 15*g* and then bent and crimped. Then, the second crimp warp 14*b* is extended toward the ninth fiber layer 15*i* in the thickness-wise direction Z. Subsequently, the second crimp warp 14*b* is engaged with the outer surface of the main material weft 12 included in the eighth weft row 12*h*, which is adjacent to the seventh weft row 12*g*, and the ninth fiber layer 15*i* and then bent and crimped. Then, the second crimp warp 14*b* is extended toward the seventh fiber layer 15*g* in the thickness-wise direction Z. The second crimp warp 14*b* is engaged with the outer surface of the main material weft 12 included in the ninth weft row 12*i*, which is adjacent to the eighth weft row 12*h*, and the seventh fiber layer 15*g* and then bent and crimped.

In this manner, among the fifth weft row 12*e*, the seventh weft row 12*g*, and the ninth weft row 12*i* arranged in the first direction X in the non-binding portion 16, the second crimp warp 14*b* is crimped by the main material weft 12 of the seventh fiber layer 15*g* in the seventh weft row 12*g* and the ninth weft row 12*i*. In the fifth weft row 12*e*, the second crimp warp 14*b* is crimped by the main material weft 12 of the fifth fiber layer 15*e* to bind the main material warp 11*a* in the thickness-wise direction Z.

The first crimp warps 13*a* to 13*b* and the second crimp warps 14*a* to 14*b* form the non-binding portions 16 from the fourth weft row 12*d* to the ninth weft row 12*i*. Each non-binding portion 16 includes the slit 18 serving as the separation part separating the warp fiber layer 111*a* and the weft fiber layer 112*a* in the thickness-wise direction Z. The fifth fiber layer 15*e* and the third fiber layer 15*c*, which are crimped by the first crimp warps 13*a* to 13*b*, forms a gap defining the slit 18 with the seventh fiber layer 15*g* and the fifth fiber layer 15*e*, which are crimped by the second crimp warps 14*a* to 14*b*. The slit 18 extends over the entire multilayer fabric 10 in the second direction Y. The main material wefts 12 forming the fifth fiber layer 15*e* are divided into the main material wefts 12 located in the vicinity of the third fiber layer 15*c* and the main material wefts 12 located in the vicinity of the seventh fiber layer 15*g*. Further, the main material warps 11*a* to 11*b* are alternately crimped to form the intersections A at the boundaries 24 of the non-binding portions 16 and the binding portions 17.

The main material warp 11*a* forms interlacing portions 23 at the fifth weft row 12*e* and the eighth weft row 12*h* on the inner surface of the slit 18 located in the vicinity of the seventh fiber layer 15*g*. The interlacing portions 23 pass through the space between the fifth fiber layer 15*e* and the seventh fiber layer 15*g*, which are crimped by the second crimp warps 14*a* to 14*b*. Further, the main material warp 11*a* forms the non-interlacing portions 22 at the fourth weft row 12*d*, the sixth weft row 12*f*, the seventh weft row 12*g*, and the ninth weft row 12*i* on the inner surface of the slit 18. In the non-interlacing portions 22, the main material warp 11*a* is not crimped by the second crimp warps 14*a* to 14*b*.

The main material warp 11*b* forms the interlacing portions 23 at the fourth weft row 12*d*, the sixth weft row 12*f*, the seventh weft row 12*g*, and the ninth weft row 12*i* on the inner surface of the slit 18 located in the vicinity of the fifth fiber layer 15*e*. The interlacing portions 23 pass through the space between the third fiber layer 15*c* and the fifth fiber layer 15*e*, which are crimped by the first crimp warps 13*a* to 13*b*. Further, the main material warp 11*b* forms the non-interlacing portions 22 at the fifth weft row 12*e* and the eighth weft row 12*h* on the inner surface of the slit 18. In the non-interlacing portions 22, the main material warp 11*b* is not crimped by the first crimp warps 13*a* to 13*b*.

Each of the above embodiments may be modified as described below.

In each of the above embodiments, the warps may be replaced by the wefts.

The number of the interlacing wefts in the third weft row 12*c* and the number of the interlacing wefts in the seventh weft row 12*g* is not limited to two and may be one or three or more.

In each of the above embodiments, when the multilayer fabric 10 is viewed in the depthwise direction V, the main material warp 11*a* and the main material warp 11*b* are alternately arranged to have an opposite-phase relationship. Instead, for example, a set of two main material warps 11*a* and a set of two main material warps 11*b* may be alternately arranged. Additionally, the number of the main material warps that form each set of the main material warps 11*a* and 11*b* may be three or more.

The number of the warps 9 arranged in the depthwise direction V may be changed.

The slits 18 may be formed between the center line M of the thickness-wise direction Z of the multilayer fabric 10 and the first fiber layer 15*a* and between the center line M and the eleventh fiber layer 15*k*.

The weft fiber layers 112*a* may be bound by crimping the main material wefts 12 only with the main material warps 11.

The invention claimed is:

1. A multilayer fabric comprising:

a first direction yarn group that includes a plurality of first direction yarns extending in a first direction, wherein the first direction yarns are arranged in a depthwise direction and a thickness-wise direction, an axis in the depthwise direction is orthogonal to an axis in the first direction, and an axis in the thickness-wise direction is orthogonal to the axis in the first direction and the axis in the depthwise direction;

a second direction yarn group that includes a plurality of second direction yarns extending in a second direction, wherein the second direction yarns are arranged in the first direction and the thickness-wise direction, an axis in the second direction is orthogonal to the axis in the first direction, and the second direction yarn group includes a plurality of second direction yarn layers that are arranged in parallel to the first direction;

a first portion in which second direction yarn layers that are stacked in the thickness-wise direction are all bound by the first direction yarns; and a second portion including a separation part where, among the second direction yarn layers, two of the second direction yarn layers that are adjacent in the thickness-wise direction are not bound to each other by the first direction yarns, wherein an intersection is formed at each of two ends of the separation part at a boundary of the first portion and the second portion, and the intersection is formed by intersecting first direction yarns that are adjacent in the second direction, and a portion including first direction yarns stacked in the thickness-wise direction is defined as a plane, the plane comprising a first plane and a second plane that are arranged in order in the depthwise direction, and the intersection being formed by a first direction yarn of the first plane and a first direction yarn of the second plane.

2. The multilayer fabric according to claim 1, wherein the first direction yarns comprises a crimp first direction yarn that forms the second portion and a main material first direction yarn extending in the first direction, the first direction yarns comprises a plurality of main material first direction yarn layers stacked in the thickness-wise direction, two of the second direction yarn layers that are adjacent in the thickness-wise direction are not bound by the crimp first direction yarn at the separation part, and the intersection is formed by at least one of the main material first direction yarn layers.

3. The multilayer fabric according to claim 2, wherein the separation part includes a non-interlacing portion in which the first direction yarn is not crimped.

* * * * *